US009879571B2

(12) United States Patent
Ezaki et al.

(10) Patent No.: US 9,879,571 B2
(45) Date of Patent: Jan. 30, 2018

(54) VALVE MECHANISM FOR INTERNAL COMBUSTION ENGINE

(71) Applicant: TOYOTA JIDOSHA KABUSHIKI KAISHA, Toyota-shi, Aichi-ken (JP)

(72) Inventors: Shuichi Ezaki, Susono (JP); Hidetoshi Hirose, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 96 days.

(21) Appl. No.: 15/030,150

(22) PCT Filed: Oct. 24, 2014

(86) PCT No.: PCT/JP2014/078317
§ 371 (c)(1),
(2) Date: Apr. 18, 2016

(87) PCT Pub. No.: WO2015/064492
PCT Pub. Date: May 7, 2015

(65) Prior Publication Data

US 2016/0273414 A1 Sep. 22, 2016

(30) Foreign Application Priority Data

Oct. 31, 2013 (JP) ..... 2013-227655

(51) Int. Cl.
*F01L 1/18* (2006.01)
*F01L 1/26* (2006.01)
(Continued)

(52) U.S. Cl.
CPC ..... *F01L 1/185* (2013.01); *F01L 1/053* (2013.01); *F01L 1/18* (2013.01); *F01L 1/255* (2013.01);
(Continued)

(58) Field of Classification Search
CPC ... F01L 1/18; F01L 1/185; F01L 1/255; F01L 1/267; F01L 1/2405
(Continued)

(56) References Cited

U.S. PATENT DOCUMENTS 7,188,595 B2 * 3/2007 Hara ..... F01L 1/18 123/90.16
2008/0230023 A1 9/2008 Sugiura et al.

FOREIGN PATENT DOCUMENTS

JP 6-101434 A 4/1994
JP 2008-232078 A 10/2008
(Continued)

*Primary Examiner* — Ching Chang
(74) *Attorney, Agent, or Firm* — Andrews Kurth Kenyon LLP

(57) ABSTRACT

A valve mechanism includes: a support shaft immovably fixed to a main body of an internal combustion engine, a main arm swingably supported by the support shaft; two sub-arms arranged at both sides of the main arm; a coupling support portion swingably supporting and coupling the two sub-arms to the main arm; a cam; and a roller rotatably located in the main arm. Each of the two sub-arms includes: a drive unit pressing and driving a valve; and a contact portion contacting a plunger of a lash adjuster, the contact portion has a curved surface slidably contacting a flat surface formed in a tip portion of the plunger and having an arc-like curved surface shape of which a central axis line corresponds to a central swing axis line of the main arm in a state where the cam abuts on the roller in a base circular portion of the cam.

1 Claim, 6 Drawing Sheets

(51) Int. Cl.

| | |
|---|---|
| ***F01L 13/00*** | (2006.01) |
| ***F01L 1/255*** | (2006.01) |
| ***F01L 1/053*** | (2006.01) |
| *F01L 1/344* | (2006.01) |
| *F01L 1/24* | (2006.01) |
| *F01L 1/047* | (2006.01) |

(52) U.S. Cl.
CPC ..... *F01L 1/267* (2013.01); *F01L 13/0005* (2013.01); *F01L 13/0036* (2013.01); *F01L 1/2405* (2013.01); *F01L 1/34416* (2013.01); *F01L 13/0057* (2013.01); *F01L 2001/0473* (2013.01); *F01L 2810/04* (2013.01)

(58) Field of Classification Search
USPC ..... 123/90.39, 90.44, 90.45, 90.46
See application file for complete search history.

(56) References Cited

FOREIGN PATENT DOCUMENTS

| | | | |
|---|---|---|---|
| JP | 2011-080380 | A | 4/2011 |
| JP | 2014-077424 | A | 5/2014 |

* cited by examiner

VALVE MECHANISM FOR INTERNAL COMBUSTION ENGINE

CROSS-REFERENCE TO RELATED APPLICATIONS

This is a national phase application based on the PCT International Patent Application No. PCT/JP2014/078317 filed Oct. 24, 2014, claiming priority to Japanese Patent Application No. 2013-227655 filed Oct. 31, 2013, the entire contents of both of which are incorporated herein by reference.

TECHNICAL FIELD

The present invention relates to a valve mechanism for an internal combustion engine.

BACKGROUND ART

Patent Document 1 discloses a valve driving device for an engine in which rocker arms are mounted at both sides of a swing arm that moves around a rocker shaft as a swing fulcrum. In this device, the swing arm swings according to the rotation of a cam to allow the rocker arms to simultaneously drive valves (intake valves or exhaust valves). In this device, the swing arm is supported to be capable of moving up and down to allow a valve timing to be changed into plural cases.

PRIOR ART DOCUMENT

Patent Document

[Patent Document 1] Japanese Patent Application Publication No. 6-101434

SUMMARY OF THE INVENTION

Problems to be Solved by the Invention

A plunger of a lash adjuster typically abuts on one end of the rocker arm, and the valve clearance is automatically adjusted. However, when the swing arm is supported to be capable of moving up and down as with the above device, the adjustment of the lash adjuster affects the swing arm. As a result, the inclination of the swing arm may cause abnormity such as the generation of abnormal noise.

The present invention has been made in view of the above problems, and aims to provide a valve mechanism for an internal combustion engine capable of preventing the deterioration in the posture of a main arm and appropriately adjusting a valve clearance.

Means for Solving the Problems

The present invention is a valve mechanism for an internal combustion engine including: a support shaft; a main arm that is swingably supported by the support shaft; two sub-arms arranged at both sides of the main arm in an axial direction of the support shaft; and a coupling support portion that couples the two sub-arms to the main arm, and swingably supports the two sub-arms, wherein each of the two sub-arms includes: a drive unit at a first end thereof, the drive unit pressing and driving a valve; and a contact portion at a second end thereof, the contact portion contacting a plunger of a lash adjuster, and the support shaft is immovably fixed to a main body of the internal combustion engine.

In the above valve mechanism for an internal combustion engine, the contact portion may have a curved surface that slidably contacts a flat surface formed in a tip portion of the plunger.

Furthermore, the valve mechanism may be configured to further include: a cam including a base circular portion; and a roller rotatably mounted to the main arm through the coupling support portion, wherein the curved surface has an arc-like curved surface shape, and a central axis line of the arc-like curved surface shape is configured to correspond to a central swing axis line of the main arm in a state where the cam abuts on the roller in the base circular portion.

EFFECTS OF THE INVENTION

The present invention prevents the deterioration in the posture of a main aim and appropriately adjusts a valve clearance.

MODES FOR CARRYING OUT THE INVENTION

A description will be given of an embodiment of the present invention with use of drawings.

Figure 1:
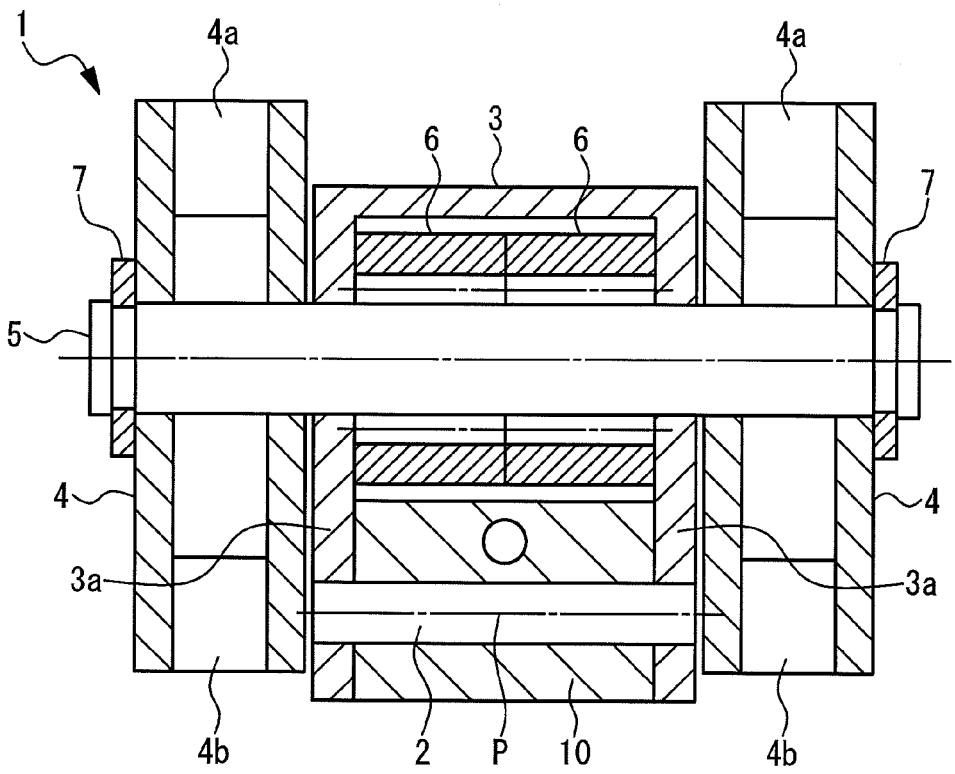
FIG. 1 is a cross-sectional view of a valve mechanism for an internal combustion engine.
Figure 2:
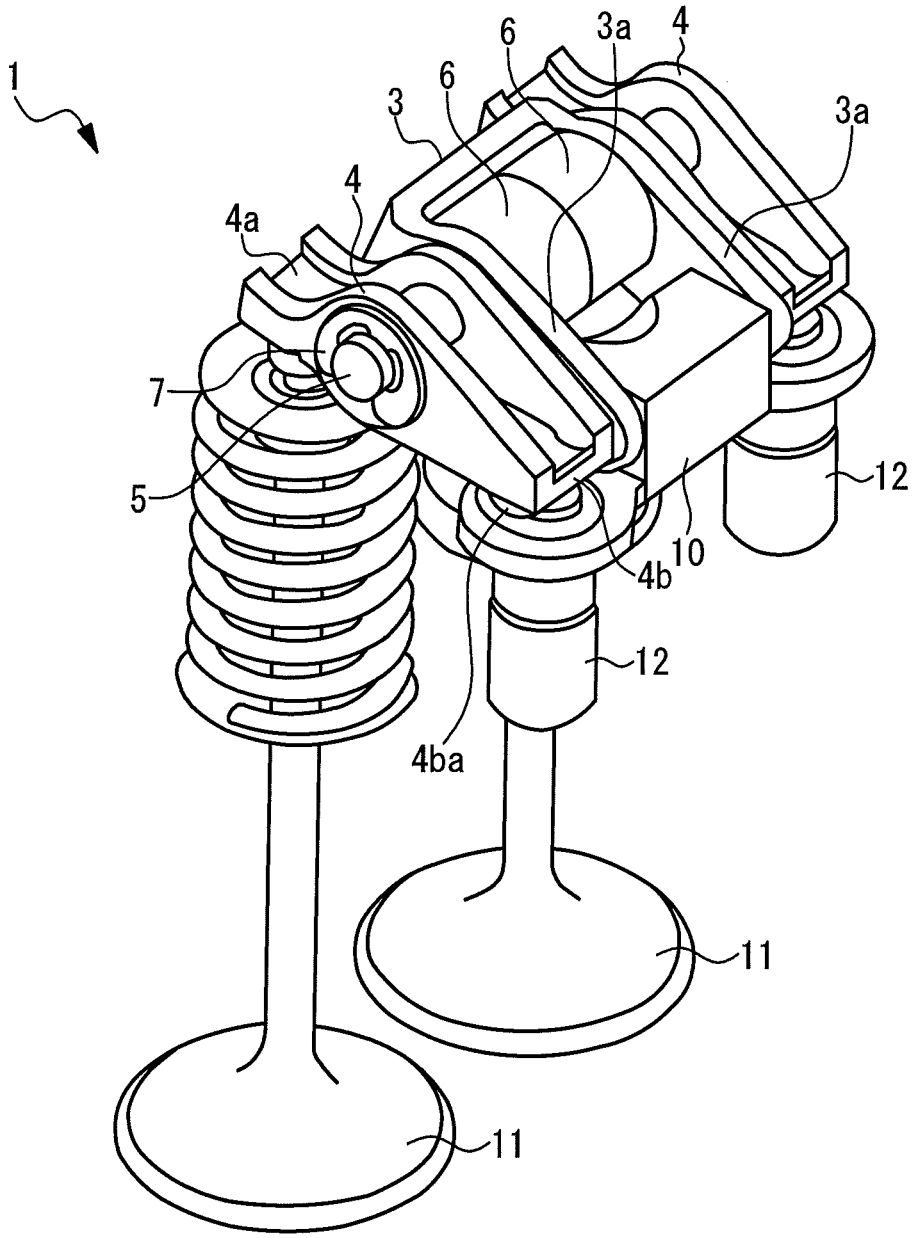
FIG. 2 is a perspective view of the valve mechanism for an internal combustion engine.
Figure 3:
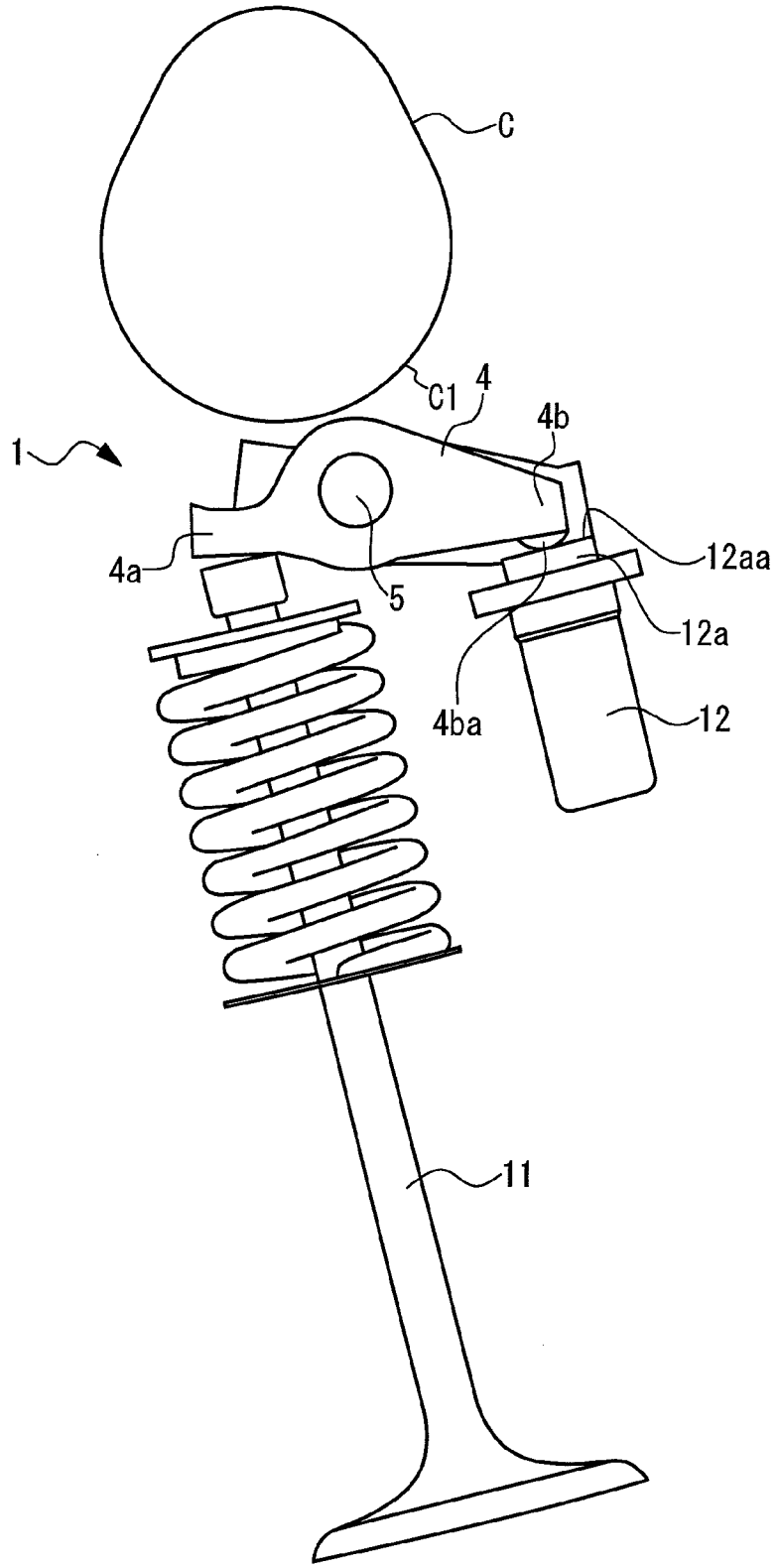
FIG. 3 is a side view of the valve mechanism for an internal combustion engine.

FIG. 1 is a cross-sectional view of a valve mechanism for an internal combustion engine (hereinafter, referred to as a valve mechanism) 1. FIG. 2 is a perspective view of the valve mechanism 1. FIG. 3 is a side view of the valve mechanism 1. FIG. 2 and FIG. 3 illustrate valves 11 and lash adjusters 12 together with the valve mechanism 1. FIG. 3 further illustrates a cam C together with the valve mechanism 1.

The valve mechanism 1 includes a support shaft 2, a main arm 3, sub-arms 4, a roller shaft 5, rollers 6, and E rings 7. The support shaft 2 is immovably fixed to a support portion 10. The support portion 10 is a part of the main body of the internal combustion engine, and is, for example, a cylinder head, or a cam carrier in particular. To immovably fix the support shaft 2 to the support portion 10, the present embodiment forms the support portion 10 in the cylinder head equipped to the internal combustion engine to fix the support shaft 2. This structure requires the cylinder head having the support portion 10, but can achieve the fixing with high rigidity. Alternatively, as another example, the support portion may be formed in, for example, a cam housing to fix the support shaft 2. When the support portion is formed in the cam housing, the dedicated cylinder head is unnecessary, and the cylinder head can be standardized. The main arm 3 is swingably supported by the support shaft 2. The main arm 3 includes two arm portions 3*a*. The arm portions 3*a* are located to face each other. The main arm 3 is arranged so as to sandwich the support portion 10 by first end portions of the arm portions 3*a*. The support shaft 2 is arranged so as to penetrate through the first end portions of the arm portions 3*a* sandwiching the support portion 10.

The sub-arms 4 are located at both sides of the main arm 3 in the axial direction of the support shaft 2. Each of the two sub-arms 4 includes a drive unit 4*a* that presses and drives the valve 11 at a first end thereof, and a contact portion 4*b* that contacts a plunger 12*a* of the lash adjuster 12 at a second end thereof. The contact portion 4*b* has a curved surface 4*ba* that slidably contacts a flat surface 12*aa* formed in a tip portion of the plunger 12*a*. The curved surface 4*ba* has an arc-like curved surface shape in particular. Further specifically, the curved surface 4*ba* has an arc-like curved surface shape of which the central axis line is configured to correspond to the central swing axis line P of the main arm 3 in a state the cam C abuts on the roller 6 in a base circular portion C1. In the present embodiment, the contact portion 4*b* of the sub-arm 4 has the curved surface 4*ba*, and the tip portion of the plunger 12*a* has the flat surface 12*aa*. However, both of them may have a curved surface, or the contact portion 4*b* of the sub-arm 4 may have a flat surface and the tip portion of the plunger 12*a* may have a curved surface. Alternatively, both of them may have a flat surface.

The roller shaft 5 is arranged so as to penetrate through second end portions of the arm portions 3*a*, and to penetrate through center portions of the sub-arms 4. The roller shaft 5 couples each of the two sub-arms 4 to the main arm 3, and swingably supports them. More specifically, the roller shaft 5 swingably couples each of the two sub-arms 4 together with the main arm 3. Additionally, the roller shaft 5 swingably supports the two sub-arms 4 around the roller shaft 5. The roller shaft 5 corresponds to a coupling support portion.

The roller 6 is a cam follower, and is rotatably mounted to the main arm 3. More specifically, the rollers 6 are rotatably mounted to the main arm 3 through the roller shaft 5. The rollers 6 are arranged at the inner side of the arm portions 3*a*. Multiple rollers 6 (here, two) are located in particular. The cam C abuts on the corresponding one of the multiple rollers 6 separately. The roller 6 makes rolling contact with the cam C to reduce friction generated between the roller 6 and the cam C. The E rings 7 are located in both end portions of the roller shaft 5. The E rings 7 are located at the outer side of each of the sub-arms 4, and totally regulate the arrangement of the main arm 3 and the sub-arms 4 in the roller shaft 5.

The valve 11 is an intake valve or an exhaust valve. The lash adjuster 12 adjusts the valve clearance of the valve 11 to be zero. The lash adjuster 12 is, for example, an HLF (hydraulic lash adjuster) in particular. The valve mechanism 1 may be considered as a mechanism further including the lash adjuster 12.

A description will next be given of the main advantage of the valve mechanism 1. In the valve mechanism 1, the support shaft 2 is immovably fixed to the support portion 10. Thus, in the valve mechanism 1, the deterioration in the posture of the main arm 3 is structurally prevented. Additionally, in the valve mechanism 1, the contact portion 4*b* has the curved surface 4*ba* that slidably contacts the flat surface 12*aa*. Thus, the valve mechanism 1 can appropriately adjust the valve clearance by adjusting the valve clearance while allowing the slide between the flat surface 12*aa* and the curved surface 4*ba*.

If the plunger 12*a* has an arc-like curved surface instead of the flat surface 12*aa*, the plunger 12*a* needs to have a rotation stopper in consideration of the contact with the curved surface 4*ba*. In this aspect, the valve mechanism 1 having the aforementioned structure can allow the rotation of the plunger 12*a*. As a result, the uneven wear of the plunger 12*a* can be reduced.

The valve mechanism 1 is structured so that the curved surface 4*ba* has an arc-like curved surface shape of which the central axis line is configured to correspond to the central swing axis line P of the main arm 3 in a state where the cam C abuts on the roller 6 in the base circular portion C1 in particular. The valve mechanism 1 with such a structure can reduce the move of the contact point between the flat surface 12*aa* and the curved surface 4*ba* because of the clearance between the central axis line and the central swing axis line P. As a result, the slide between the flat surface 12*aa* and the curved surface 4*ba* can be reduced.

The valve mechanism 1 includes multiple rollers 6 that are rotatably mounted to the main arm 3, and on which the cams C separately abut. The valve mechanism 1 with such a structure can make the valve characteristics (e.g., a lift amount and the number of times of opening valve) of the valve 11 variable by being used together with a cam switching mechanism 50 structured to include multiple (here, two) cams C. A description will next be given of this point.

Figure 4:
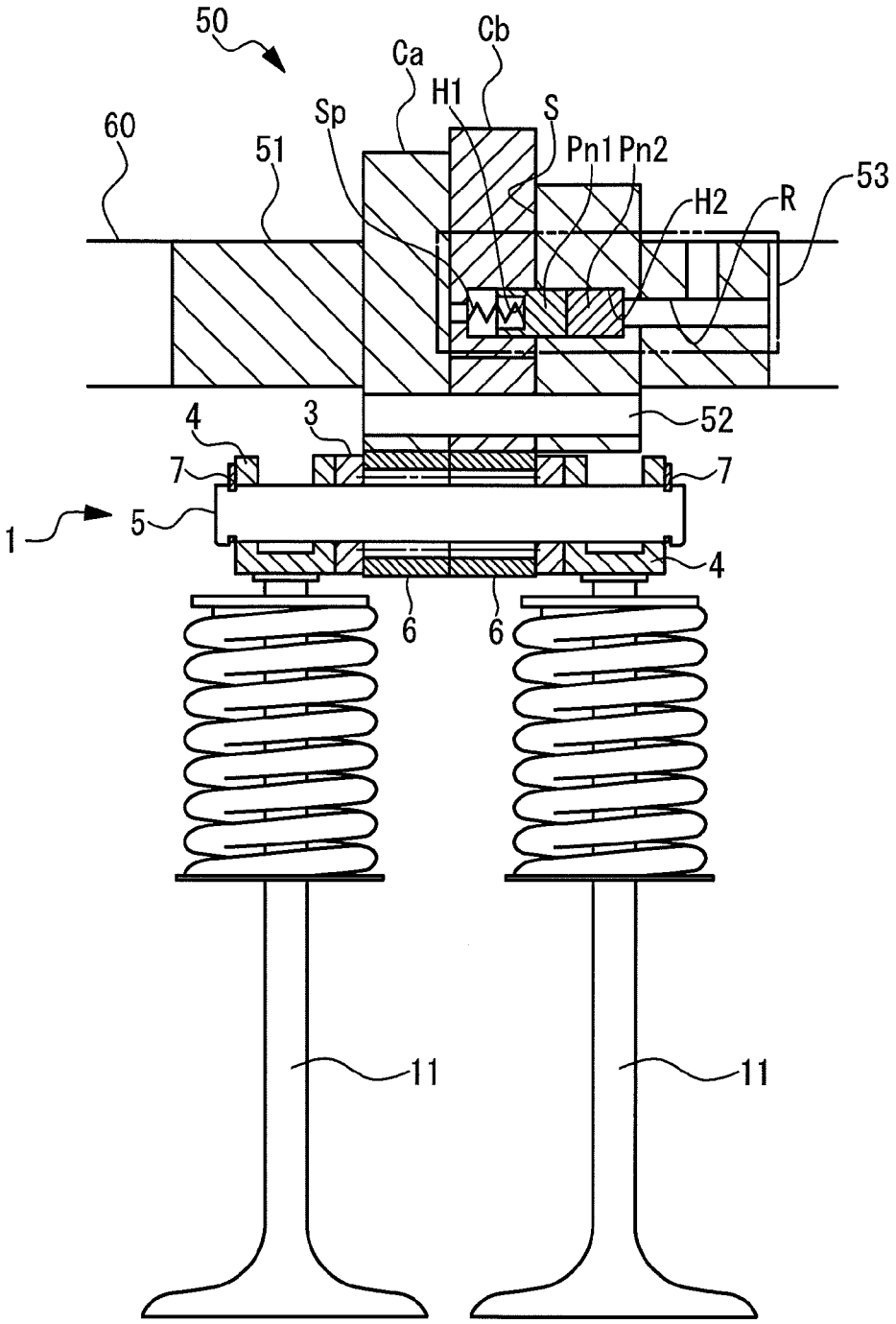
FIG. 4 is a first diagram illustrating a cam switching mechanism.
Figure 5:
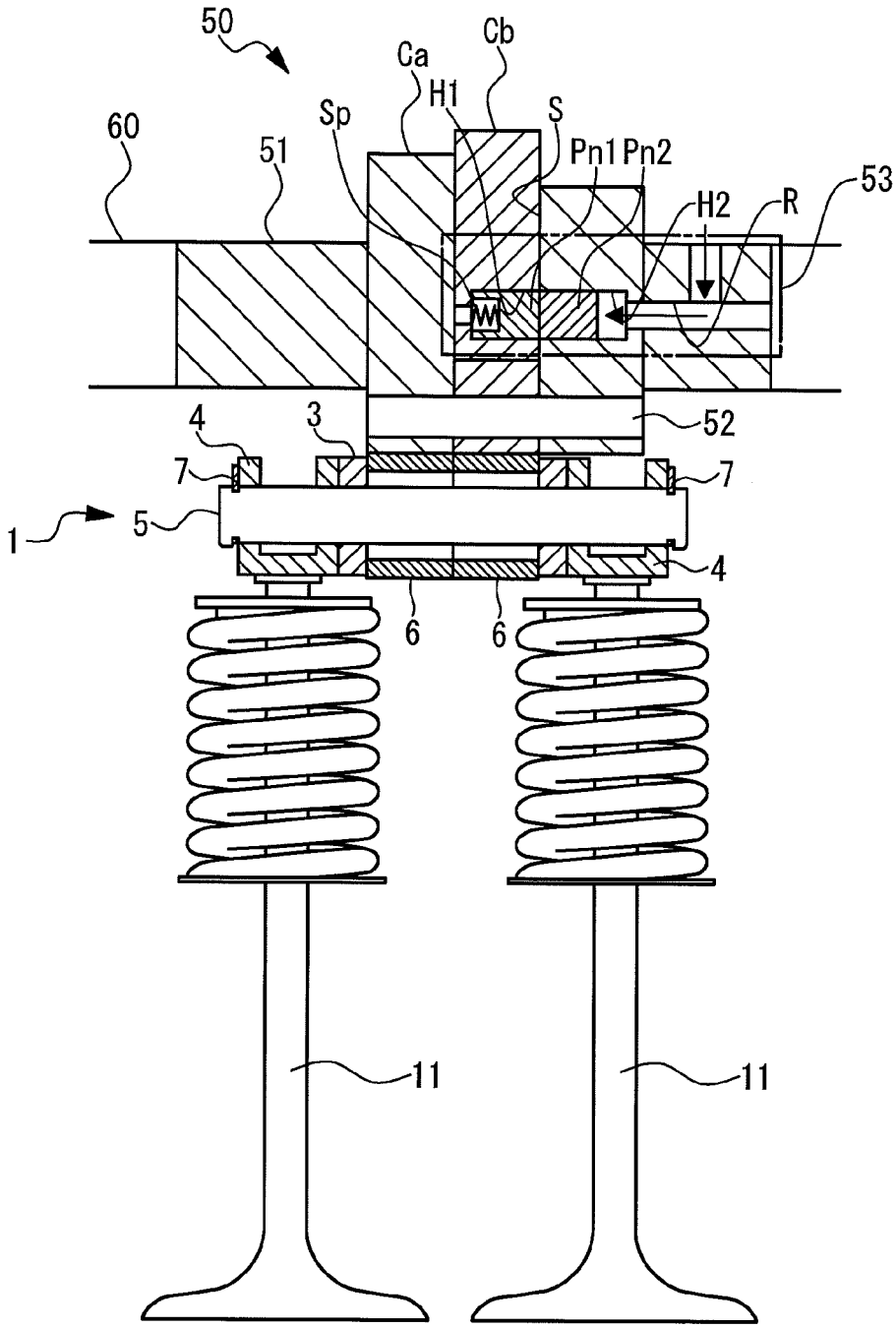
FIG. 5 is a second diagram illustrating the cam switching mechanism.
Figure 6:
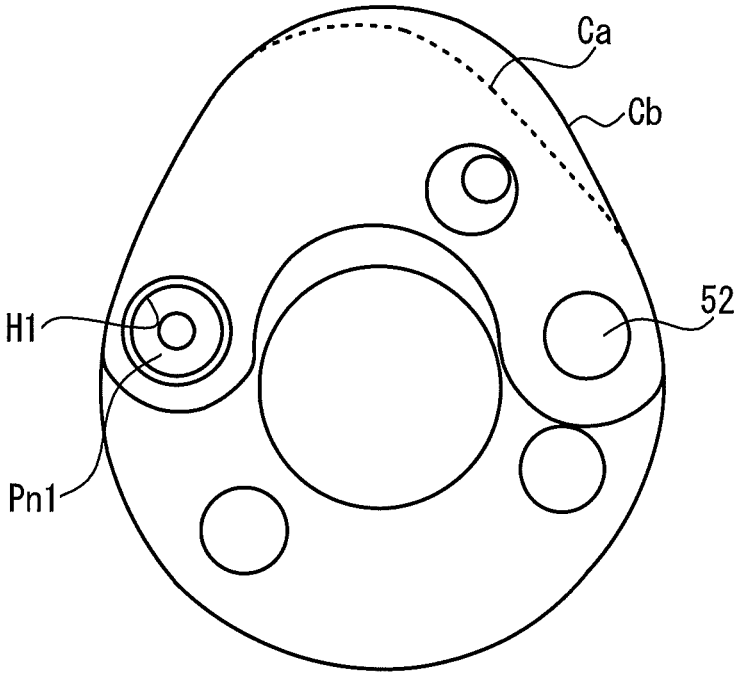
FIG. 6 is a diagram illustrating a movable cam.

FIG. 4 is a first diagram illustrating the cam switching mechanism 50. FIG. 5 is a second diagram illustrating the cam switching mechanism 50. FIG. 6 is a diagram illustrating a movable cam Cb. FIG. 4 and FIG. 5 illustrate the valve mechanism 1 and a cam shaft 60 together with the cam switching mechanism 50. FIG. 4 and FIG. 5 illustrate the cam switching mechanism 50 in a first state described later. The same applies to FIG. 6. A fixed cam Ca, and the movable cam Cb are cams that make up multiple (here, two) cams C.

The cam switching mechanism 50 includes a cam base portion 51, a fulcrum pin 52, and a lock mechanism 53. The cam base portion 51 is a substantially cylindrical rotating body, and the fixed cam Ca is formed in the cam base portion 51. The cam base portion 51 is separate from the cam shaft 60, and immovably fixed to the cam shaft 60. The cam base portion 51 may be integrated with the cam shaft 60. The cam base portion 51 includes a slit S. The slit S is located adjacent to the fixed cam Ca.

The movable cam Cb is located in the slit S. The movable cam Cb is a cam lobe portion, and has a pin hole H1 extending in the axial direction of the cam shaft 60. The pin hole H1 is a holding hole that holds a pin Pn1. The movable cam Cb is coupled to the cam base portion 51 so that the movable cam Cb oscillates between the first state in which the movable cam Cb protrudes from the outer periphery of the cam base portion 51 (more specifically, the outer periphery of the fixed cam Ca) and a second state in which the movable cam Cb is at a position lower than that in the first state. The second state will be described later.

The movable cam Cb has a chevron curved shape in particular, and a first end portion thereof is rotatably supported by the fulcrum pin 52. The pin hole H1 is formed in a second end portion of the movable cam Cb. A pin hole H2 and an oil passage R are formed in a part opposite to the fixed cam Ca across the slit S in the cam base portion 51. The pin hole. H2 extends in the axial direction of the cam shaft 60. The oil passage R communicates with the bottom portion of the pin hole H2.

The movable cam Cb is biased to the first state by an unillustrated biasing member (e.g., a return spring) in a state where the lock by the lock mechanism 53 is released as described later. In the first state, the pin hole H1 and the pin hole H2 are aligned in the axial direction of the cam shaft 60. The biasing force of the biasing member can be configured to be within a range that allows the movable cam Cb to move into the second state by the reaction force from the roller 6.

The lock mechanism 53 includes pins Pn1, Pn2 and a spring Sp in addition to the pin hole H1, the pin hole H2, and the oil passage R. The pin Pn1 is a lock member, and held by at least the pin hole H1 of the pin holes H1, H2. The pin Pn2 is held by the pin hole H2 of the pin holes H1, H2. The spring Sp is located between the bottom portion of the pin hole H1 and the pin Pn1. The spring Sp biases the pin Pn1 so that the pin Pn1 is inserted into the pin hole H2 in the first state.

The lock operation of the lock mechanism 53 is as follows. That is to say, first, the pin hole H1 and the pin hole H2 are aligned in the axial direction of the cam shaft 60 in the first state. At this time, the spring Sp biases the pin Pn1, and the pin Pn1 thereby moves together with the pin Pn2, and is held by the pin hole H1 and the pin hole H2. As a result, the movable cam Cb is locked. Accordingly, the lock mechanism 53 locks the movable cam Cb in the first state. The pin hole H2 is a lock hole to which the pin Pn1 is aligned in the axial direction in the first state.

The lock release operation of the lock mechanism 53 is as follows. That is to say, when the hydraulic pressure acts on the pin Pn2 through the oil passage R, the pin Pn2 moves against the biasing force of the spring Sp together with the pin Pn1. As a result, the pin Pn1 is held by the pin hole H1 of the pin holes H1, H2, and the pin Pn2 is held by the pin hole H2. As a result, the lock of the movable cam Cb is released. The oil passage R is a passage for exerting the hydraulic pressure so that the pin Pn1 is disconnected from the pin hole H2 in the first state.

A description will next be given of an example of the variable operation of the cam switching mechanism 50. When the cam profiles of the fixed cam Ca and the movable cam Cb are configured so that the lift amount of the valve 11 with use of the fixed cam Ca is less than that with use of the movable cam Cb, the cam switching mechanism 50 operates as follows. That is to say, the cam switching mechanism 50 drives the valve 11 by the movable cam Cb in a state where the movable cam Cb is locked. Moreover, the cam switching mechanism 50 drives the valve 11 by the fixed cam Ca and allows the movable cam Cb to be in a lost-motion state in a state where the lock of the movable cam Cb is released. The second state is a state where the movable cam Cb is in a lost-motion state.

When each of the cam profiles of the fixed cam Ca and the movable cam Cb is configured so that the valve 11 is opened twice for one combustion cycle, the cam switching mechanism 50 operates as follows. That is to say, the fixed cam Ca and the movable cam Cb drive the valves 11 at different timings in a state where the movable cam Cb is locked. Moreover, the cam switching mechanism 50 drives the valve 11 by the fixed cam Ca and allows the movable cam Cb to be in a lost-motion state in a state where the lock of the movable cam Cb is released.

When the fixed cam Ca is a zero lift cam that does not lift the valve 11, the cam switching mechanism 50 can allow the valve 11 not to operate in a state where the lock of the movable cam Cb is released. The combination use of the valve mechanism 1 and the cam switching mechanism 50 allows the valve characteristics of the valve 11 to be variable as described above in particular.

The lock mechanism 53 may further include: a second lock hole that is formed in the cam base portion 51 and to which the pin Pn1 is aligned in the axial direction of the cam shaft 60 in the second state; a second spring that biases the pin Pn1 so that the pin Pn1 moves out from the second lock hole in the second state, and a second passage that is formed in the cam base portion 51 and exerts the hydraulic pressure so that the pin Pn1 is inserted into the second lock hole in the second state. In this case, the pin hole H2 may be a first lock hole, the spring Sp may be a first spring, and the oil passage R may be a first passage.

While the exemplary embodiments of the present invention have been illustrated in detail, the present invention is not limited to the above-mentioned embodiments, and other embodiments, variations and variations may be made without departing from the scope of the present invention.

DESCRIPTION OF LETTERS OR NUMERALS

Valve mechanism 1
Support shaft 2
Main arm 3
Sub-arm 4
Drive unit 4*a*
Contact portion 4*b*
Curved surface 4*ba*
Roller shaft 5
Roller 6
Support portion 10
Valve 11
Lash adjuster 12
Plunger 12*a*
Flat surface 12*aa*
Cam C
Base circular portion C1

The invention claimed is:

1. A valve mechanism for an internal combustion engine comprising:

a support shaft;

a main arm that is swingably supported by the support shaft;

two sub-arms arranged at both sides of the main arm in an axial direction of the support shaft;

a coupling support portion that couples the two sub-arms to the main arm, and swingably supports the two sub-arms;

a cam including a base circular portion; and a roller rotatably mounted to the main arm through the coupling support portion, wherein each of the two sub-arms includes:

a drive unit at a first end thereof, the drive unit pressing and driving a valve; and a contact portion at a second end thereof, the contact portion contacting a plunger of a lash adjuster, the support shaft is immovably fixed to a main body of the internal combustion engine, the contact portion has a curved surface that slidably contacts a flat surface formed in a tip portion of the plunger, the curved surface has an arc-like curved surface shape, and a central axis line of the arc-like curved surface shape is configured to correspond to a central swing axis line of the main arm in a state where the cam abuts on the roller in the base circular portion.

* * * * *